US005374381A

United States Patent [19]

Schuld et al.

[11] Patent Number: 5,374,381

[45] Date of Patent: Dec. 20, 1994

[54] EVAPORATIVE ELEMENT FOR A HUMIDIFIER AND METHOD OF MAKING THE SAME

[75] Inventors: Richard P. Schuld, Palatine; Daniel E. Schuld, Elmhurst, both of Ill.

[73] Assignee: RPS Products, Inc., Hampshire, Ill.

[21] Appl. No.: 154,941

[22] Filed: Nov. 19, 1993

Related U.S. Application Data

[63] Continuation of Ser. No. 974,088, Nov. 10, 1992, abandoned.

[51] Int. Cl.[5] ..... B01F 3/04

[52] U.S. Cl. ..... 261/106; 261/107; 261/DIG. 41; 428/118; 156/197

[58] Field of Search ..... 261/106, 107, DIG. 41; 428/118; 156/197

[56] References Cited

U.S. PATENT DOCUMENTS

| | | | |
|---|---|---|---|
| Re. 31,675 | 9/1984 | Vesper . | |
| 765,412 | 7/1904 | Budwig | 156/197 |
| 1,917,456 | 7/1933 | Mickelson | 156/197 |
| 2,001,632 | 5/1935 | Schlichting | 156/197 |
| 2,031,055 | 2/1936 | McKinney . | |
| 2,356,757 | 8/1944 | Fleisher | 261/106 |
| 2,377,527 | 6/1945 | Siefken . | |
| 3,006,798 | 10/1961 | Holland | 156/197 |
| 3,045,450 | 7/1962 | Chandler . | |
| 3,084,609 | 4/1963 | Onstad . | |
| 3,193,259 | 7/1965 | Liebmann | 261/106 |
| 3,275,074 | 9/1966 | Campbell et al. . | |
| 3,351,995 | 11/1967 | Johnson . | |
| 3,497,188 | 2/1970 | McDuffee | 261/106 |
| 3,520,763 | 7/1970 | Holland | 156/197 |
| 3,782,081 | 1/1974 | Munters . | |
| 3,878,594 | 4/1975 | Minor, Jr. | 261/106 |
| 3,912,634 | 10/1975 | Howell | 210/222 |
| 4,045,523 | 8/1977 | Goettl . | |
| 4,144,624 | 3/1979 | Szego et al. . | |
| 4,231,975 | 11/1980 | Peltier . | |
| 4,338,266 | 7/1982 | Flower | 261/106 |
| 4,461,733 | 7/1984 | Otterbein . | |
| 4,504,290 | 3/1985 | Pontius . | |
| 4,544,513 | 10/1985 | Otterbein . | |
| 4,552,795 | 11/1985 | Hansen et al. | 428/118 |
| 4,556,521 | 12/1985 | Baigas, Jr. . | |
| 4,566,290 | 1/1986 | Otterbein . | |
| 4,610,705 | 9/1986 | Sarnosky et al. . | |
| 4,672,820 | 6/1987 | Goettl | 261/106 |
| 4,758,385 | 7/1988 | Acker et al. . | |
| 4,762,650 | 8/1988 | Bosman | 261/106 |
| 4,822,533 | 4/1989 | Steiner et al. . | |
| 4,865,775 | 9/1989 | Steiner et al. . | |
| 4,879,075 | 11/1989 | Hinton . | |
| 4,902,449 | 2/1990 | Hobbs . | |
| 4,921,745 | 5/1990 | Mitsui et al. | 156/197 |
| 4,933,117 | 6/1990 | Wilson | 261/106 |
| 4,935,169 | 7/1990 | Ernst . | |
| 5,106,668 | 4/1992 | Turner et al. | 428/118 |

FOREIGN PATENT DOCUMENTS

| | | | |
|---|---|---|---|
| 54100 | 1/1938 | Denmark . | |
| 869527 | 2/1942 | France | 261/106 |
| 3312367 | 4/1983 | Germany . | |
| 3508615 | 3/1985 | Germany . | |

*Primary Examiner*—Tim Miles

*Attorney, Agent, or Firm*—Juettner Pyle Lloyd & Piontek

[57] ABSTRACT

An evaporative element or cartridge especially useful in humidifiers comprises a plurality of stacked slit and expanded wicking paper layers, and means for supporting the wicking paper. The supporting means may comprise a layer of slit and expanded metal sandwiched in between the stacked wicking paper layers. The stacked wicking paper and metal layers are held together with an adhesive. Alternatively, the supporting means may comprise a rigid frame on the side edges of the stacked wicking paper layers, the frame having prongs engaging the wicking paper layers. Each layer of stacked wicking paper is staggered with respect to adjoining layers. The wicking paper has superior capillary rise of 79 to 112 mm/min.

18 Claims, 3 Drawing Sheets

EVAPORATIVE ELEMENT FOR A HUMIDIFIER AND METHOD OF MAKING THE SAME

This is a continuation of copending application Ser. No. 07/974,088 filed on Nov. 10, 1992, now abandoned.

BACKGROUND OF THE INVENTION

The present invention relates to evaporative elements and cartridges for use in humidifiers, evaporative coolers and the like. The invention specifically relates to paper evaporative elements.

For many years humidifiers have been manufactured and sold having replaceable evaporative elements, sometime also known as cartridges. The purpose of the evaporative element is to spread water over a large surface area to promote evaporation of the water into the air when air is directed over and through the element. The evaporative element may also perform a subsidiary function of filtering the air and/or water. It is well recognized in the art that it is desirable to have an element, through which air may freely pass, having a large surface area. It is also well known to make the evaporative element from materials that will promote capillary or wicking action to absorb and spread the water throughout the evaporative element. The evaporative element should be made of materials and with a configuration sufficient to maintain structural integrity of the evaporative element when it is subjected to prolonged use in water, heat and air flow conditions.

To meet these objectives, the art has developed several types of evaporative elements. One type is slit and expanded metal element. U.S. Pat. No. 3,878,594 issued to Carrier Corporation illustrates one such element. The slit and expanded metal element is made by forming a stack or bundle of layers of slit and expanded metal, by well known techniques. The element is used by trickling water downwardly through the element. The slit and expanded metal inherently consists of a lattice of bridges and strings set at inclined angles as a result of the expansion process. These inclined bridges and strings act as baffles to catch, divert and spread the water throughout the element. The advantages of this type of element is that they are durable and inexpensively manufactured. The disadvantage of the expanded metal units are that metal has very low absorption and capillary action properties.

Another well known evaporative element is a paper element. U.S. Pat. No. 4,822,533 issued to Emerson Electric Company illustrates a paper evaporative element. Paper elements have the advantage of better absorption and capillary action properties. However, they are considerably more expensive to manufacture because specialized paper folding equipment is typically needed. Furthermore, paper elements often lack sufficient structural strength due to prolonged exposure to water and air flow if constructed by more simplistic techniques.

Accordingly, there is in the art an ongoing need for an evaporation element that has high water absorption and capillary action, good structural integrity and which may be economically manufactured. It is therefore the object of the invention to satisfy these needs.

SUMMARY OF THE INVENTION

The present invention is an evaporative element comprising multiple layers of slit and expanded wicking paper in combination with a rigid supporting means to prevent the paper from sagging. The term "wicking paper" is intended herein to mean blotter type papers having superior capillary rise properties. A preferred rigid supporting means comprises at least one layer of slit and expanded metal sandwiched between the wicking paper layers. The wicking paper has exceptional water absorption and capillary action. The metal layer provides structural strength. Conventional machinery for slitting and expanding metal foils and paper may be used, resulting in a very economical manufacturing process.

Another preferred rigid supporting means comprises a rigid frame bordering the side edges of the stack of wicking paper layers. The frame preferably includes prongs on the interior of the frame which engage the stacked, expanded wicking paper layers. Thereby the frame supports the wicking paper and prevents sagging.

Accordingly, the objects of the invention have been well satisfied. These advantages and others will become more fully apparently from the following detailed description when read in conjunction with the accompanying drawings.

DETAILED DESCRIPTION

Figure 1:
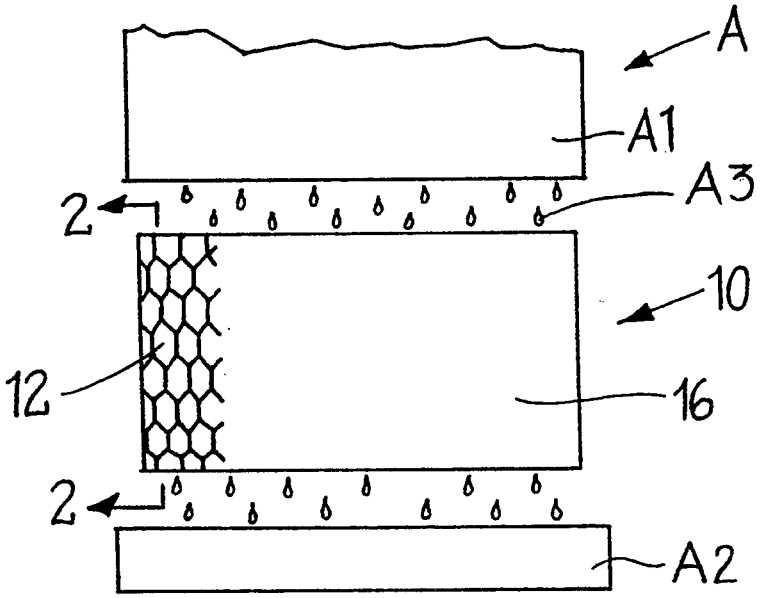
FIG. 1 is a perspective view of a trickle down type humidifier incorporating an evaporative element of the invention.

Referring now to the drawings, a first embodiment of the evaporator element 10 of the invention is shown in operation in a humidifier A. The humidifier A is shown diagrammatically as comprising a water source $A_1$ and a water collection pan $A_2$. Water $A_3$ is directed from source $A_1$ through evaporator element 10 and is collected for recirculation in pan $A_2$. Air is preferably directed by a fan, blower or other means (not shown) through element 10 in a direction normal to the surface of the drawing. The trickle down type of humidifier A is merely shown as one example of a use for the evaporative element of the invention.

Alternatively, the evaporative element of the invention may be used in other types of humidifiers, including wick-up types where the element is partially immersed in a water bath, or rotary types where the evaporative element is partially immersed in a bath and rotated. Additionally, the element of the invention may be used in evaporative coolers.

The evaporative element 10 comprises a plurality of layers of slit and expanded wicking paper 12 and a rigid supporting means, namely at least one layer of perforated metal 14. The perforated metal is also preferably made by slit and expanded techniques. The layers may be held together in any conventional manner. A satisfactory holding means is a hot melt adhesive, as is more fully explained below.

Figure 2:
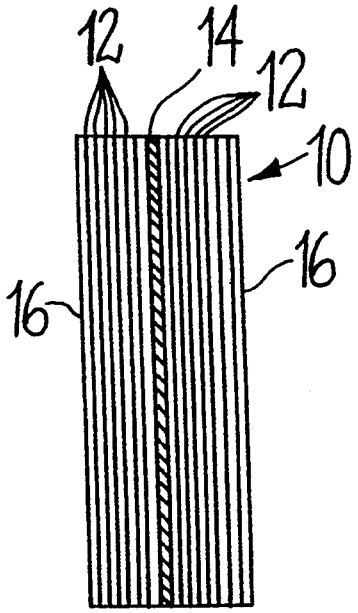
FIG. 2 is a cross sectional view of the evaporative element of the invention taken along line 2—2 of FIG. 1.
Figure 3:
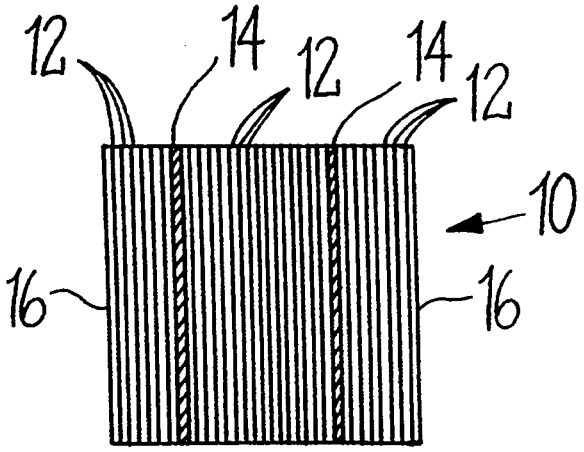
FIG. 3 is a cross sectional view showing a second embodiment of the invention.

FIG. 2 shows a first embodiment having one layer of metal 14 sandwiched between a multiplicity of layers of wicking paper 12. FIG. 3 illustrates a second embodiment showing two metal layers 14 sandwiched among a multiplicity of layers of wicking paper 12. Other configurations may be made as well. In particular, it may be desirable to locate the expanded metal layers on one or both exterior surfaces 16 of the evaporative element.

Figure 4:
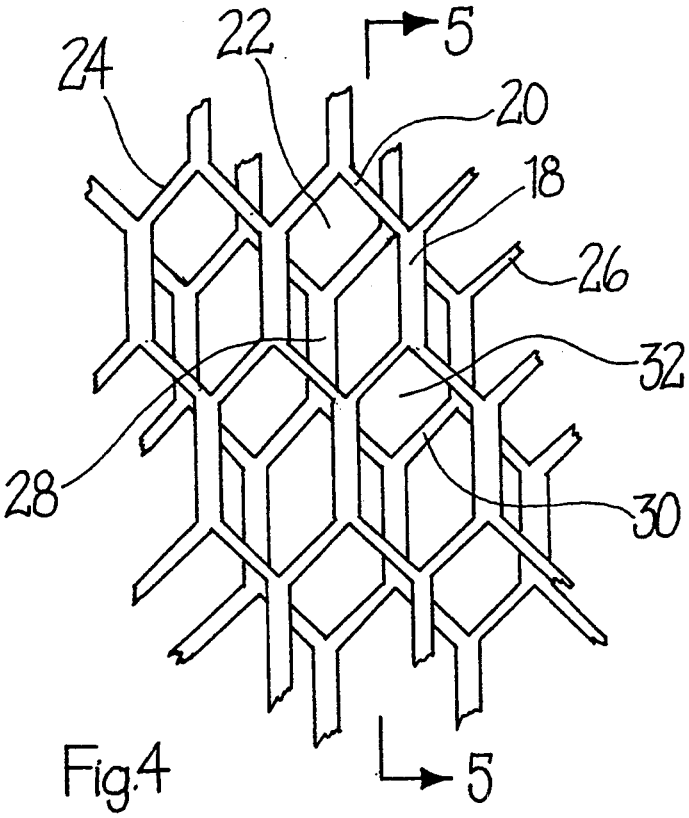
FIG. 4 is a detailed plan view of the evaporative element of the invention.
Figure 5:
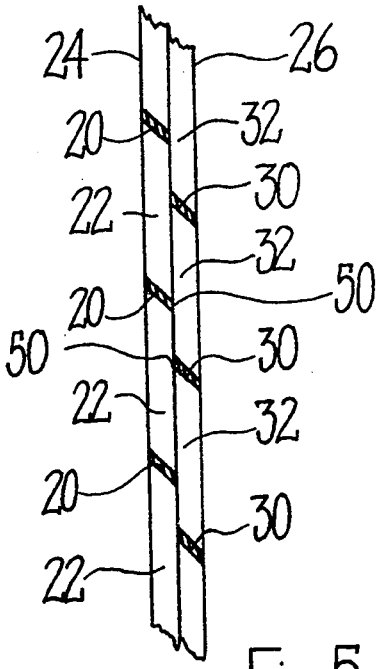
FIG. 5 is a cross sectional view taken along line 5—5 of FIG. 4.

The slit and expanded paper and metal may be manufactured by conventional processes. See for example U.S. Pat. Nos. 3,351,995 to R. S. Johnson, "Method of Making Expanded Metal," of 4,144,624 to A. Szego and V. Kallay, "Machine for Expanding Metal Webs." When the paper is slit and expanded, it forms a lattice of bridges 18 and strings 20 defining openings 22 therein, as shown in FIG. 4. It is desirable to stagger the openings in adjoining sheets. Thus, as shown in FIGS. 4 and 5, a layer 24 is staggered with respect to adjoining layer 26. Specifically, the bridges 18, strings 20 and openings 22 of outer sheet 24 are staggered with respect to the respective bridges 28, strings 30 and openings 32 of the adjoining layer 26. The staggering of adjoining layers exposes a greater surface area of the wicking material to air flow.

Figure 6:
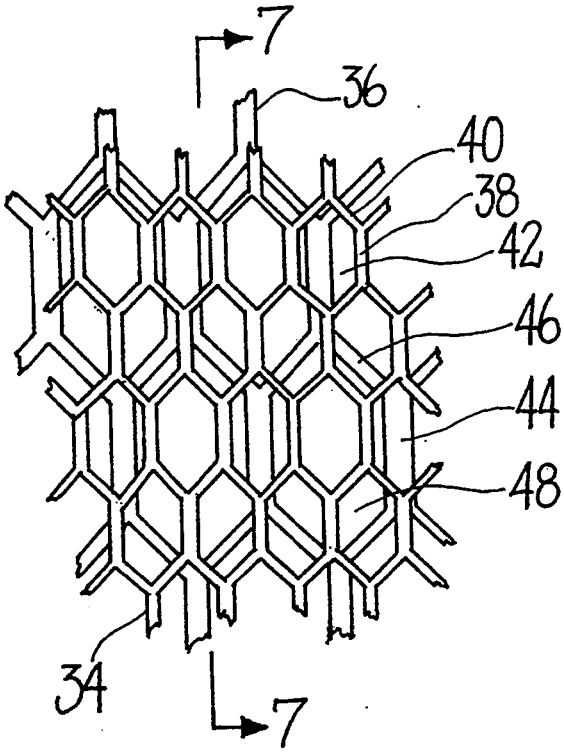
FIG. 6 is a detailed plan view of an alternative configuration of the wicking paper of the invention.
Figure 7:
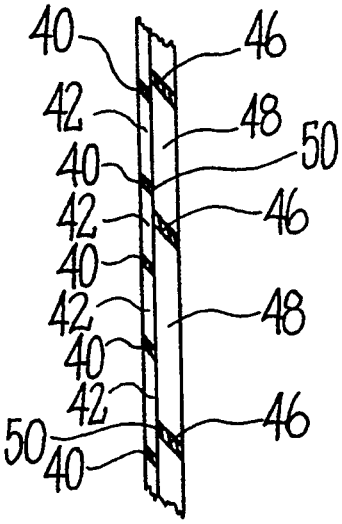
FIG. 7 is a cross sectional view taken along line 7—7 of FIG. 6.

A third embodiment is shown in FIGS. 6 and 7. In this embodiment, adjoining wicking paper layers 34 and 36 have different lattice configurations. The layer 34 has relatively smaller openings than adjoining layer 36. As with the embodiment of FIGS. 4 and 5, the respective bridges 38, strings 40 and openings 42 of the one layer 34 are staggered with respect to the bridges 44, strings 46 and openings 48 of the adjoining layer 36. Preferably, the respective layers with small 34 and large 36 openings are alternated. With the combination of altering and staggering lattices in adjoining layers, additional wetted surface area of the wicking paper may be exposed to the air passing through the evaporative element, further improving the evaporative performance of the element.

As may be seen in FIGS. 4 through 7, the bridges and strings of each layer have a particular orientation due to the slitting and expanding process. It has been found desirable to orientate each layer of wicking paper so that the bridges are in a vertical direction. Thus, as shown in FIGS. 4 and 7, the bridges 18, 28, 38 and 44 are vertical. The vertical orientation of the bridges promotes capillary rise of water through the filter. It is also desirable to vertically orientate the bridges of the expanded metal layer, as slit and expanded metal has superior strength in the vertical direction.

The preferred vertical orientation of the bridges of the invention is contrary to conventional thought in the art. Conventionally, slit and expanded metal evaporative elements have horizontally orientated bridges. The reason for this is that the natural inclination of the bridges is useful for catching and diverting cascading water. Applicant has discovered that a vertical orientation is superior for expanded wicking paper, however.

A most important aspect of the invention is the material chosen for fabrication of the wicking paper layers. Applicant has discovered that Ahlstrom Filtration grade No. 939-39 paper made by Ahlstrom Filtration, Inc., Mt. Holly Springs, Pa. 17065, is an excellent wicking paper for fabrication of the evaporative element of the invention. The Ahlstrom paper is 97–100% cellulose fiber with a trace of polyamide wet strength resin. The paper has a basis weight of 37–41 lbs. per ream (20 in.×20 in.×500 sheets). It has a thickness of 0.026 to 0.036 inches. Its wet burst is 150" $H_2O$ min. The Frazier permeability of the Ahlstrom paper is 30–40 cm/ft.$^2$. Most importantly, the Ahlstrom grade No. 939.39 paper has a capillary rise of 79–112 mm/min. The excellent capillary rise ability of the paper greatly enhances the spreading of water throughout the evaporative element, which improved the evaporative rate.

The slit and expanded metal layer preferably comprises aluminum sheet having a thickness of about 0.008 inches. However, other metals could be used. Aluminum is a preferred metal because of its resistance to corrosion and light weight. The chosen gauge of the metal is largely dependent on the size of the evaporative element and the number of metal layers to be used. It is desirable to use a minimal amount of metal—just enough to maintain structural integrity of the evaporative element—as the metal is inferior to the paper in capillary action and is more expensive.

As noted earlier, the various layers of wicking paper and metal may be held together in any conventional manner. It has been found desirable to lightly apply hot melt adhesive to the edges 50 of the bridges 18 and 28 and strings 20 and 32 of each layer of wicking material and metal. A bond is thereby formed at each intersection of a bridge or string in adjoining layers. By coating only the edges, the surface area of the wicking material remains free of adhesive which could hinder the evaporation function.

Four example configurations for evaporative elements made in accordance with the invention are as follows:

EXAMPLE 1

Overall dimensions 6 in.×10½ in.×2½ in. thick

Construction: 7 layers of wicking paper followed by 1 layer of aluminum followed by 9 layers of wicking paper Paper: slits 1⅜ in. long at ⅝ in. spacing bridge 5/16 in., string 5/32 in. openings ⅝ in.×1¼ in.

Metal: slits ⅝ in. at ¼ in. spacing bridge ⅛ in., string 1/16 in. openings ¼ in.×½ in.

EXAMPLE 2

Overall dimensions 6 in.×10 ½ in.×4¾ in. thick

Construction: 7 layers of wicking paper followed by 1 layer of aluminum followed by 16 layers of wicking paper followed by 1 layer of aluminum followed by 9 layers of wicking paper Paper: slits 1⅜ in. long at ⅝ in. spacing bridge 5/16 in., string 5/32 in. openings ⅝ in. at ¼ in.

Metal: slits ⅝ in. at ¼ in. spacing bridge ⅛ in., string 1/16 in. openings ¼ in.×½ in.

EXAMPLE 3

Overall dimensions 5½ in.×5¾×4¾ in. thick

Construction: 8 layers of wicking paper followed by 1 layer of aluminum followed by 16 layers of wicking paper followed by 1 layer of aluminum followed by 8 layers of wicking paper Paper: $1\frac{1}{2}$ in. slits at $\frac{1}{2}$ in. spacing bridge 5/16 in., string 5/32 in. openings $\frac{5}{8}$ in.×1 in.

Metal: slits $\frac{5}{8}$ in. at $\frac{1}{4}$ in. spacing bridge $\frac{1}{8}$ in., string 1/16 in. openings $\frac{1}{4}$ in.×$\frac{1}{2}$ in.

EXAMPLE 4

Overall dimensions $6\frac{3}{4}$ in.×$7\frac{7}{8}$ in.×$2\frac{3}{4}$ in. thick Construction: 6 layers each of alternating small and large opening wicking paper followed by 1 layer of aluminum followed by 6 layers each of alternating small and large opening wicking paper Paper 1: 11/6 slits at 5/32 in. spacing bridge 3/16 in., string 3/32 in. openings $\frac{1}{4}$ in.×9/16 in.

Paper 2: $1\frac{1}{2}$ in. slits at $\frac{1}{2}$ in. spacings bridge 5/16 in., string 5/32 in. openings $\frac{1}{2}$ in.×$1\frac{1}{8}$ in.

Metal: slits $\frac{5}{8}$ in. at 3/16 in. spacing bridge 5/32 in., string 5/64 in. openings $\frac{1}{4}$ in.×9/16 in.

Figure 8:
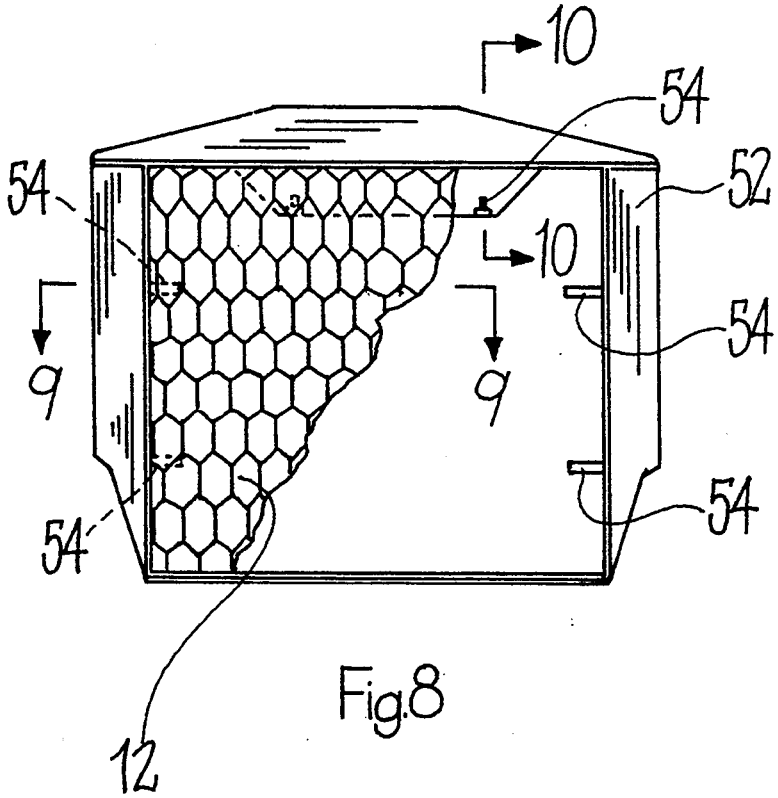
FIG. 8 is a plan view of a third embodiment of the invention.
Figure 9:
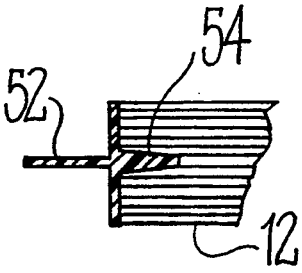
FIG. 9 is a cross sectional view taken along line 9—9 of FIG. 8.
Figure 10:
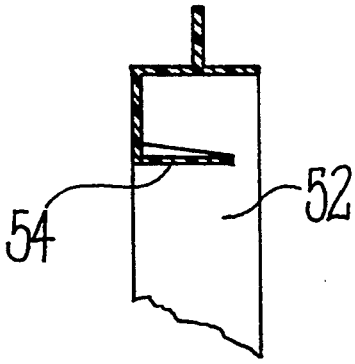
FIG. 10 is a cross sectional view taken along line 10—10 of FIG. 8.

FIGS. 8 through 10 illustrate a fourth embodiment of the invention. The rigid supporting means comprises a plastic frame 52. The interior surface of frame 52 preferably has one or more prongs 54 that extend into and engage the stacked layers of wicking paper 12. The frame serves the same function as the expanded metal, i.e., to support the wicking paper and prevent it from sagging. The frame may be described as an exoskeleton, whereas the metal layer would be an endoskeleton.

The frame 52 is preferably made from a substantially rigid plastic by conventional injection molding techniques. As the frame is made from durable plastic, it has a useful life longer than the wicking paper. Accordingly, the frame may be reused by removing and replacing the stacked wicking paper. Replacement is facilitated with the frame of the invention because the wicking paper is held in the frame by prongs rather than by a more permanent means, i.e., glue.

For added support, one may combine both support means in one evaporative element. The evaporative element would comprise plural stacked layers of expanded wicking paper, at least one layer of slit and expanded metal sandwiched in between the wicking paper layers, a rigid frame bordering the edges of the stacked wicking paper layers, and means for holding the assembly together.

FIG. 8 shows a total of two prongs each on the sides and top portions of frame 52. It should be understood that fewer or more prongs may be desirable for any particular evaporative element. One commercial unit made by applicant's assignee has two prongs on each side portion and no prongs at the top. Another commercial unit has two prongs on the top portion of the frame, and two pairs of prongs on one side portion only. Other configurations may be apparent to those skilled in the art, and are within the contemplated scope of the invention.

While preferred embodiments and example configurations have been shown and described, it is to be understood that various further modifications and additional configurations will be apparent to those skilled in the art. It is intended that the specific embodiments and configurations disclosed are illustrative of the preferred and best modes for practicing the invention, and should not be interpreted as limitations on the scope of the invention as defined by the appended claims.

We claim:

1. An evaporative element for a humidifier or the like, comprising: a plurality of stacked layers of slit and expanded wicking paper; at least one layer of perforated, substantially rigid material juxtaposed to at least one of said layers of wicking paper for supporting said layers of wicking paper; and adhesive means for bonding said layers of paper together and for bonding said rigid material layer to said paper layers, forming a laminated evaporative element.

2. An evaporative element as in claim 1, wherein each of said layers of slit and expanded wicking paper comprises a lattice of bridges and strings defining said multiplicity of openings, at least a portion of said layers of wicking paper being staggered in relation to adjoining layers of said wicking paper so that the openings in the respective adjoining layers are staggered in relation to each other.

3. An evaporative element as in claim 1, wherein said plurality of layers of wicking paper comprises a first layer of wicking paper having bridges and strings defining said openings in said first layer and a second layer of wicking paper have bridges and strings defining said openings in said second layer, and wherein the openings of said first layer are substantially smaller than the openings in said second layer.

4. An evaporative element as in claim 3, wherein said plurality of layers of wicking paper comprises alternating first and second layers.

5. An evaporative element as in claim 1, wherein said at least one perforated rigid material layer comprises a layer of slit and expanded metal.

6. An evaporative element as in claim 1, comprising plural layers of said perforated rigid material, and wherein at least one layer of said layers of wicking paper being sandwiched in between said rigid material layers.

7. An evaporative element as in claim 6, wherein said plural layers of perforated rigid material comprise slit and expanded metal.

8. An evaporative element as in claim 1, wherein said rigid material layer is sandwiched between said layers of wicking paper.

9. An evaporative element as in claim 1, wherein said layer of rigid material comprises a slit and expanded metal lattice of bridges and strings forming openings therebetween, said openings comprising the perforations in said perforated rigid material layer, said bridges being about $\frac{1}{8}$ inch wide, and said openings being about $\frac{1}{2}$ inch long by about $\frac{1}{4}$ inch wide.

10. An evaporative element as in claim 1, wherein said wicking paper has a Frazier permeability of at least 30 cfm/ft$^2$.

11. An evaporative element as in claim 1, wherein said wicking paper has a capillary rise of at least 79 millimeters per minute.

12. An evaporative element for a humidifier, comprising: a multiplicity of layers of slit and expanded wicking paper, each said layer having a lattice of bridges and strings defining openings therein, each said layer of wicking paper being stacked one to the other, the openings in each layer being staggered in relation to adjoining layers, said wicking paper having a capillary rise of at least 79 mm per minute; at least one layer of slit and expanded metal sandwiched between said multiplicity of layers of slit and expanded wicking paper; and means for holding together said layers of wicking paper and said layer of metal.

13. An evaporative element as in claim 12, comprising plural layers of slit and expanded metal, and wherein at least one of said layers of wicking paper is sandwiched between said plural layers of slit and expanded metal.

14. An evaporative element for a humidifier comprising: a plurality of stacked layers of slit and expanded wicking paper; and at least one layer of slit and expanded metal sandwiched between said layers of wicking paper.

15. A method of making a humidifier wicking element, comprising the steps of slitting and expanding a plurality of sheets of wicking paper, stacking the layers of wicking paper, slitting and expanding at least one layer of metal foil, placing the layer of metal foil juxtaposed to the layers of wicking paper, and laminating the paper and metal layers together into a composite wicking element.

16. A method as in claim 15, wherein an adhesive is used in laminating the paper and metal layers together.

17. A method as in claim 15 wherein a plurality of layers of metal foil are slit and expanded and juxtaposed to the paper layers.

18. A method as in claim 17 wherein at least one layer of the slit and expanded paper is sandwiched between the layers of metal foil.

* * * * *